US009114901B2

(12) United States Patent
Apps

(10) Patent No.: US 9,114,901 B2
(45) Date of Patent: Aug. 25, 2015

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 243 days.

(21) Appl. No.: 13/370,415

(22) Filed: Feb. 10, 2012

(65) Prior Publication Data

US 2012/0205263 A1 Aug. 16, 2012

Related U.S. Application Data

(60) Provisional application No. 61/441,777, filed on Feb. 11, 2011.

(51) Int. Cl.

| | |
|---|---|
| ***B65D 1/24*** | (2006.01) |
| ***B65D 1/36*** | (2006.01) |
| ***B65D 21/00*** | (2006.01) |

(52) U.S. Cl.

CPC ..... *B65D 1/243* (2013.01); *B65D 2501/2407* (2013.01); *B65D 2501/24019* (2013.01); *B65D 2501/2435* (2013.01); *B65D 2501/24114* (2013.01); *B65D 2501/24127* (2013.01); *B65D 2501/24146* (2013.01); *B65D 2501/24267* (2013.01); *B65D 2501/24515* (2013.01); *B65D 2501/24687* (2013.01)

(58) Field of Classification Search

CPC ..... B65D 2501/24108; B65D 2501/24019; B65D 71/70; B65D 39/00; B65D 39/088; Y10T 16/05

USPC ..... 220/516, 519, 509, 513, 518, DIG. 15, 220/711, 4.26; 206/427, 509, 519, 203, 206/503, 139

See application file for complete search history.

(56) References Cited

U.S. PATENT DOCUMENTS

| | | | |
|---|---|---|---|
| 2,512,855 | A | 6/1950 | Erickson |
| 2,530,481 | A | 11/1950 | Rawn, Jr. |
| 2,526,335 | A | 12/1950 | Diechert |
| 2,970,715 | A | 2/1961 | Kappel et al. |

(Continued)

FOREIGN PATENT DOCUMENTS

| | | |
|---|---|---|
| DE | 10 2007 050061 | 12/2008 |
| EP | 1 124 730 | 8/2001 |

(Continued)

OTHER PUBLICATIONS

European Search Report for EP Application No. 12155177.4, Mar. 22, 2012.

*Primary Examiner* — Shawn M Braden

(74) *Attorney, Agent, or Firm* — Carlson, Gaskey & Olds

(57) ABSTRACT

A tray includes a base including a plurality of base walls each having a peripheral wall defining a container-receiving pocket therein. Adjacent pairs of the peripheral walls of the base walls are spaced apart to define low-profile lateral and longitudinal dividers. The base includes a generally horizontal upper divider wall connecting the peripheral walls. A plurality of side columns have outer walls extending up from upper portions of side walls and have inner walls extending down to the base. The side columns are arranged between spaced apart lower portions of the side walls. A pair of opposed end walls each include an upper bar and a lower bar extending between a pair of corner columns. A handle opening is defined between the upper bar and the lower bar. Each lower bar is connected to the base by an end inner wall.

18 Claims, 11 Drawing Sheets

(56) References Cited

U.S. PATENT DOCUMENTS

| | | | | | |
|---|---|---|---|---|---|
| 3,055,531 | A | | 9/1962 | De Chelbor | |
| 3,055,542 | A | * | 9/1962 | Russo | 206/163 |
| 3,247,996 | A | | 4/1966 | Garcia | |
| 3,392,869 | A | | 7/1968 | Needt | |
| 3,416,694 | A | | 12/1968 | Bebb | |
| 3,428,207 | A | | 2/1969 | Scholler | |
| 3,812,996 | A | | 5/1974 | Bunnell | |
| 4,162,738 | A | | 7/1979 | Wright | |
| 4,344,530 | A | | 8/1982 | deLarosiere | |
| 4,538,742 | A | | 9/1985 | Prodel | |
| 4,615,444 | A | * | 10/1986 | de Larosiere | 206/427 |
| 4,899,874 | A | | 2/1990 | Apps et al. | |
| 4,911,303 | A | | 3/1990 | Andersson | |
| 4,944,400 | A | * | 7/1990 | Van Onstein et al. | 206/509 |
| 4,978,000 | A | | 12/1990 | Mohr | |
| 5,031,749 | A | * | 7/1991 | McCoy | 198/408 |
| 5,060,819 | A | * | 10/1991 | Apps | 220/519 |
| 5,096,085 | A | | 3/1992 | Eek et al. | |
| 5,184,748 | A | * | 2/1993 | Apps | 220/519 |
| 5,267,649 | A | | 12/1993 | Apps et al. | |
| 5,305,884 | A | | 4/1994 | Apps et al. | |
| 5,316,172 | A | | 5/1994 | Apps et al. | |
| 5,320,245 | A | | 6/1994 | Apps et al. | |
| 5,351,814 | A | | 10/1994 | Apps | |
| 5,377,862 | A | | 1/1995 | Oakes et al. | |
| 5,405,042 | A | | 4/1995 | Apps et al. | |
| 5,465,843 | A | | 11/1995 | Koefelda | |
| 5,495,945 | A | | 3/1996 | Apps et al. | |
| 5,501,352 | A | | 3/1996 | Apps | |
| 5,529,176 | A | | 6/1996 | Apps et al. | |
| 5,575,390 | A | | 11/1996 | Apps et al. | |
| D378,249 | S | | 3/1997 | Apps et al. | |
| D379,717 | S | | 6/1997 | Apps et al. | |
| D380,901 | S | | 7/1997 | Apps et al. | |
| 5,651,461 | A | | 7/1997 | Apps et al. | |
| 5,660,279 | A | | 8/1997 | Apps et al. | |
| 5,704,482 | A | * | 1/1998 | Apps et al. | 206/510 |
| 5,769,230 | A | | 6/1998 | Koefelda | |
| D395,954 | S | | 7/1998 | Apps et al. | |
| 5,823,376 | A | | 10/1998 | McGrath | |
| D401,764 | S | | 12/1998 | Apps et al. | |
| 5,842,572 | A | | 12/1998 | Apps et al. | |
| 5,855,277 | A | | 1/1999 | Apps et al. | |
| D410,778 | S | | 6/1999 | Apps et al. | |
| 5,971,204 | A | | 10/1999 | Apps | |
| 6,073,793 | A | | 6/2000 | Apps et al. | |
| 6,079,554 | A | * | 6/2000 | Hammett et al. | 206/203 |
| 6,112,938 | A | | 9/2000 | Apps | |
| 6,189,734 | B1 | | 2/2001 | Apps et al. | |
| D446,015 | S | | 8/2001 | Apps | |
| D461,957 | S | | 8/2002 | Hammett | |
| D462,522 | S | | 9/2002 | Apps et al. | |
| 6,454,120 | B1 | | 9/2002 | Hammett | |
| 6,457,599 | B1 | | 10/2002 | Apps et al. | |
| D465,417 | S | | 11/2002 | Apps | |
| D466,018 | S | | 11/2002 | Apps | |
| D468,634 | S | | 1/2003 | Hammett | |
| D483,946 | S | | 12/2003 | Koefelda | |
| D485,756 | S | | 1/2004 | Apps | |
| D487,634 | S | | 3/2004 | Apps et al. | |
| D494,867 | S | | 8/2004 | Apps | |
| 6,851,563 | B1 | * | 2/2005 | Lipari | 211/74 |
| D505,014 | S | | 5/2005 | Apps et al. | |
| 6,892,885 | B2 | | 5/2005 | Apps et al. | |
| 6,899,247 | B1 | | 5/2005 | Koefelda et al. | |
| D507,880 | S | | 8/2005 | Hassell et al. | |
| 6,966,442 | B2 | | 11/2005 | Hassell et al. | |
| 7,017,746 | B2 | | 3/2006 | Apps | |
| 7,086,531 | B2 | | 8/2006 | Apps et al. | |
| 7,097,033 | B2 | | 8/2006 | Koefelda et al. | |
| 7,128,234 | B2 | | 10/2006 | Apps et al. | |
| 7,207,458 | B1 | | 4/2007 | Koefelda et al. | |
| 7,252,196 | B1 | | 8/2007 | Koefelda et al. | |
| 7,281,641 | B2 | | 10/2007 | Apps | |
| 7,322,475 | B2 | | 1/2008 | Hassell et al. | |
| 7,322,486 | B2 | * | 1/2008 | Koefelda et al. | 220/516 |
| 7,549,539 | B2 | | 6/2009 | Apps | |
| 7,604,122 | B2 | | 10/2009 | Apps et al. | |
| 7,677,405 | B2 | | 3/2010 | Apps et al. | |
| 7,694,839 | B2 | | 4/2010 | Koefelda et al. | |
| D615,758 | S | | 5/2010 | Lindstrom | |
| 7,735,676 | B2 | | 6/2010 | Ogburn | |
| 7,743,939 | B2 | | 6/2010 | Stahl | |
| 7,950,521 | B2 | | 5/2011 | Apps | |
| 8,056,753 | B2 | | 11/2011 | Koefelda et al. | |
| 2002/0148837 | A1 | | 10/2002 | Apps | |

FOREIGN PATENT DOCUMENTS

| | | |
|---|---|---|
| FR | 1350962 | 1/1964 |
| FR | 2302244 | 9/1976 |
| GB | 758817 | 10/1956 |

* cited by examiner

STACKABLE LOW DEPTH TRAY

This application claims priority to U.S. Provisional Application Ser. No. 61/441,777, filed Feb. 11, 2011.

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

SUMMARY

The present invention relates to a stackable low depth tray for storing and transporting beverages containers, such as bottles. The tray includes a base including a plurality of base walls each having a peripheral wall defining a container-receiving pocket therein. Adjacent pairs of the peripheral walls of the base walls are spaced apart to define low-profile lateral and longitudinal dividers. The base includes a generally horizontal upper divider wall connecting the peripheral walls. A pair of opposed side walls each include an upper portion and a plurality of spaced apart lower portions. A plurality of side columns have outer walls extending up from the upper portions of the side walls and have inner walls extending down to the base. The side columns are arranged between the spaced apart lower portions of the side walls. A pair of opposed end walls each include an upper bar and a lower bar extending between a pair of corner columns. A handle opening is defined between the upper bar and the lower bar. Each lower bar is connected to the base by an end inner wall. A recess is defined below the lower bar and outwardly of the end inner wall for receiving the upper bar of a lower identical tray nested therebelow.

DETAILED DESCRIPTION OF THE PREFERRED EMBODIMENT

Figure 1:
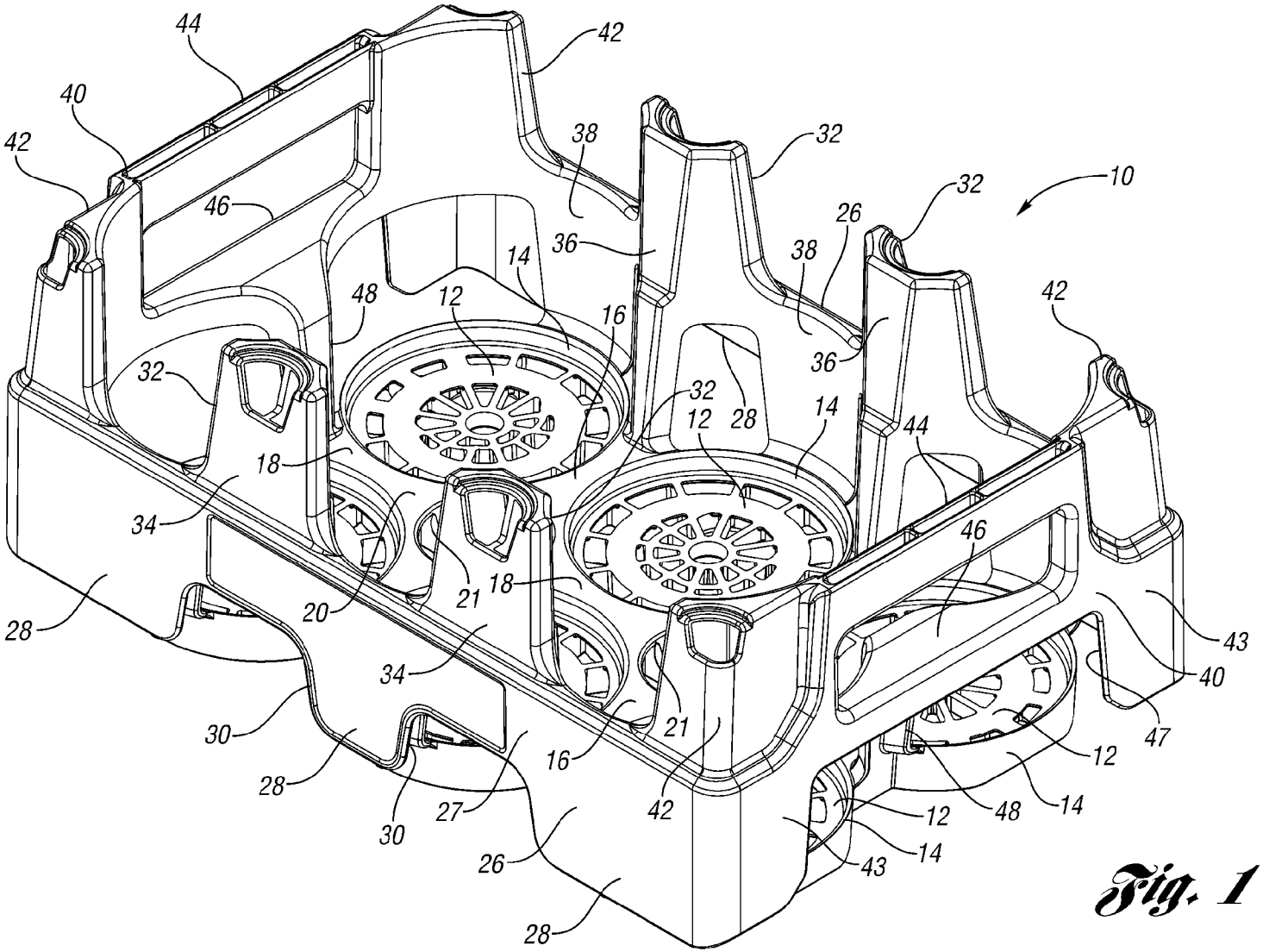
FIG. 1 is a perspective view of a tray according to one embodiment of the present invention.

A tray 10 according to one embodiment of the present invention is shown in FIG. 1. The tray 10 includes a plurality (in this example, six) of spaced apart base walls 12, each having a short peripheral wall 14 defining a bottle-receiving pocket therein. Adjacent pairs of portions of the peripheral walls 14 define lateral dividers 16 and longitudinal dividers 18. The lateral dividers 16 and longitudinal dividers 18 include a generally horizontal upper divider wall 20 connecting the adjacent portions of the peripheral walls 14. At each intersection of the lateral dividers 16 and longitudinal dividers 18 is defined a relatively large opening 21 therethrough. The lateral dividers 16 and longitudinal dividers 18 are low-profile dividers (e.g. they are wider than they are tall, such that the closest distance between two adjacent peripheral walls 14 is greater than the height of the peripheral walls 14—alternatively, the closest distance between two adjacent peripheral walls 14 does not exceed the height of the peripheral walls 14).

The tray 10 includes a pair of opposed side walls 26. Each side wall includes an upper wall portion 27 and spaced-apart lower wall portions 28. Side openings 30 are defined in the side wall 26 between the spaced-apart lower wall portions 28. A plurality of side columns 32 extend upwardly from each of the side walls 26. The side columns 32 have outer walls 34 extending up from the upper wall portions 27 of the side walls 26. The columns 32 have inner wall portions 36 extending down to the base (more specifically, the upper divider wall 20 of the lateral dividers 16). Between the columns 32, a side inner wall portion 38 extends down to the base (more specifically, to the peripheral walls 14 or base walls 12).

A pair of opposed end walls 40 extend upwardly from the base. Each end wall 40 includes an upper bar 44 and a lower bar 46 extending between a pair of corner columns 42. An outer end wall 43 extends downward from the corner columns 42. The corner columns 42 are offset inwardly or tapered inwardly relative to the outer end walls 43, side lower wall portions 28. The corner columns 42 may also be offset inwardly or tapered inwardly relative to the upper bars 44 and lower bars 46. An end inner wall 48 connects each lower bar 46 to the base (more specifically, upper divider wall 20 of longitudinal dividers 18). The upper bar 44 and lower bar 46 are spaced apart to define a handle opening in each end wall 40. An opening 47 is defined below the lower bar 46 between the outer end walls 43. The lower bars 46 are coplanar with the upper wall portions 27 of the side walls 26 to form a continuous band encircling the bottles in the tray 10.

Figure 2:
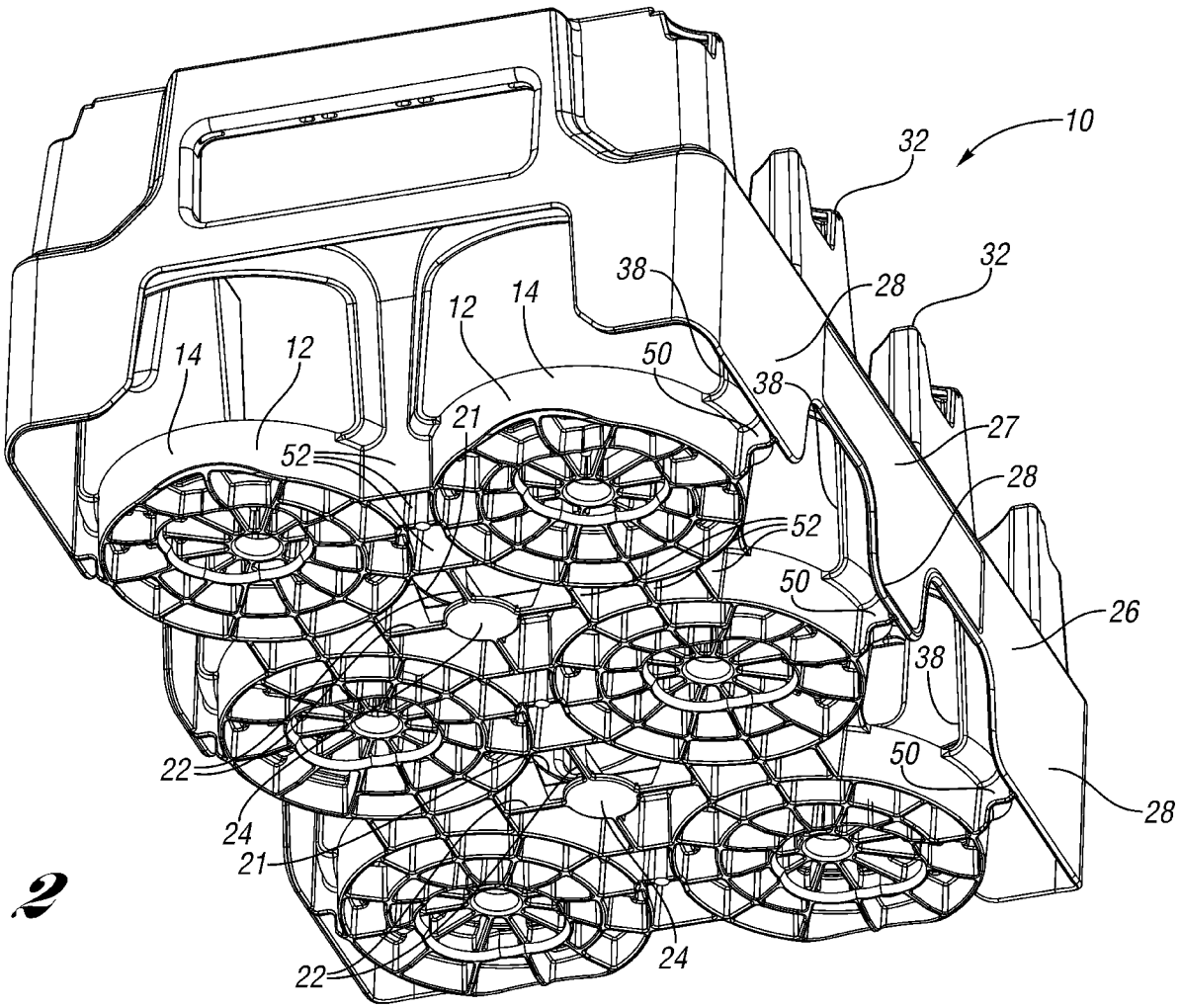
FIG. 2 is a bottom perspective view of the tray.

Referring to FIG. 2, each side inner wall portion 38 is spaced inwardly from each side lower wall portion 28 and connected by a perpendicular rib 50 therebetween. Ribs 22 perpendicular to one another extend downward and across the openings 21 between the pockets and the peripheral walls 14 down to a lower platform 24. A plurality of connecting ribs 52 (in this example, three) connect each of the base walls 12 to one another. The bottom surfaces of the platforms 24 are coplanar with the bottom edges of the downwardly-extending ribs of the base walls 12 and the connecting ribs 52 which together form the bottom-most plane of the tray 10. The base walls 12, peripheral walls 14, lateral dividers 16, longitudinal dividers 18, upper divider wall 20, ribs 22, platforms 24 and connecting ribs 52 together form the base of the tray 10.

Figure 3:
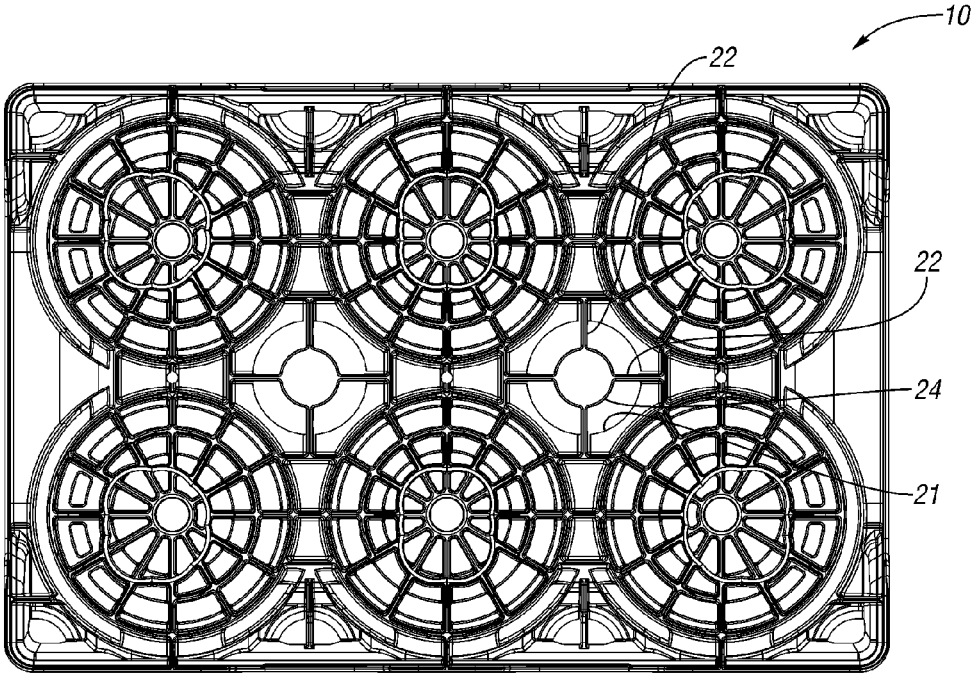
FIG. 3 is a bottom view of the tray.
Figure 4:
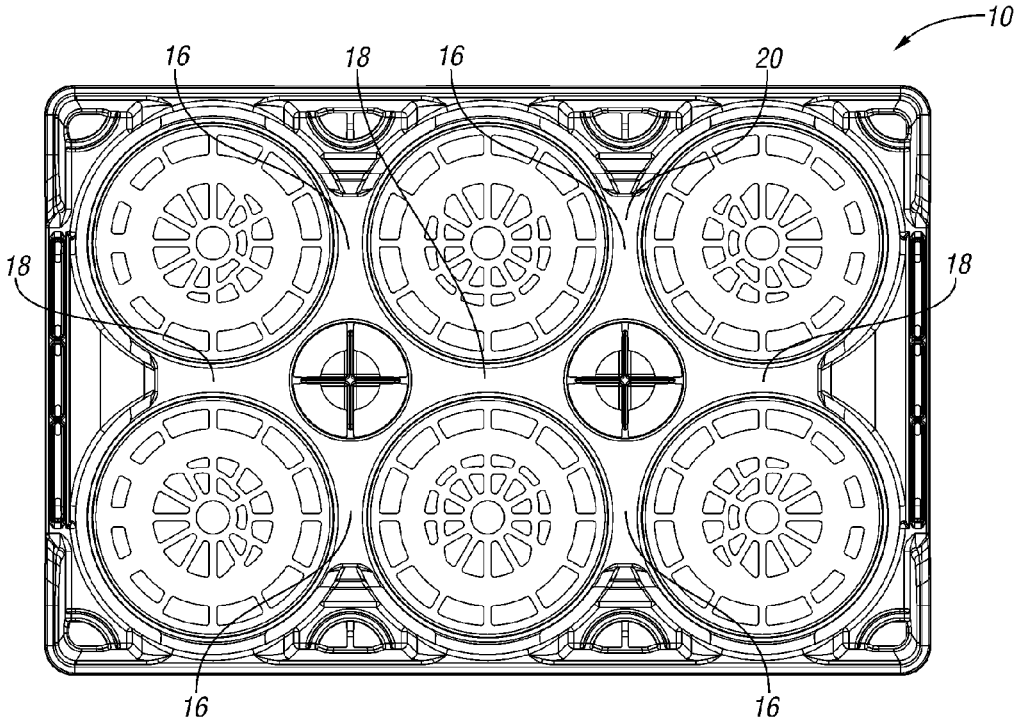
FIG. 4 is a top view of the tray.
Figure 5:
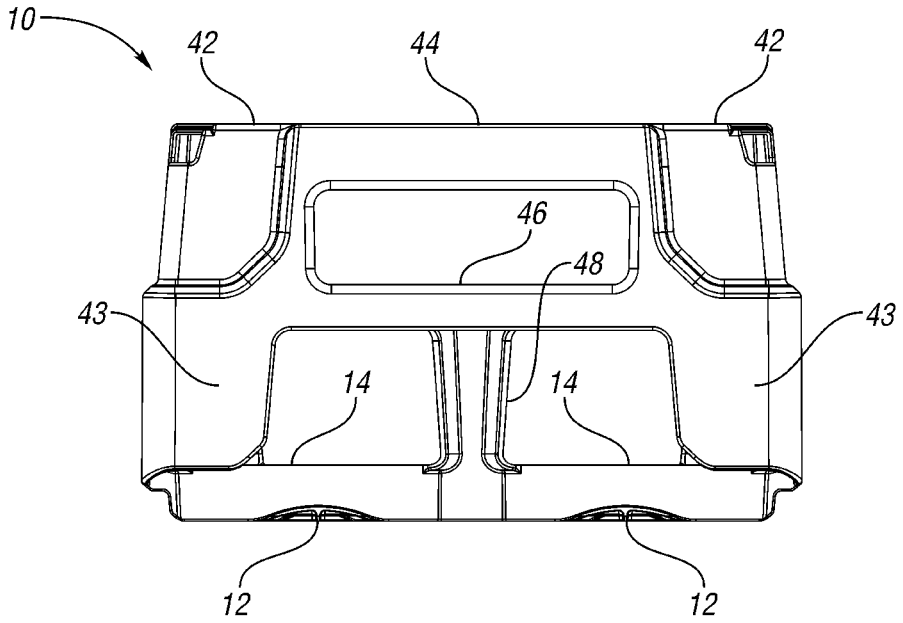
FIG. 5 is an end view of the tray.
Figure 6:
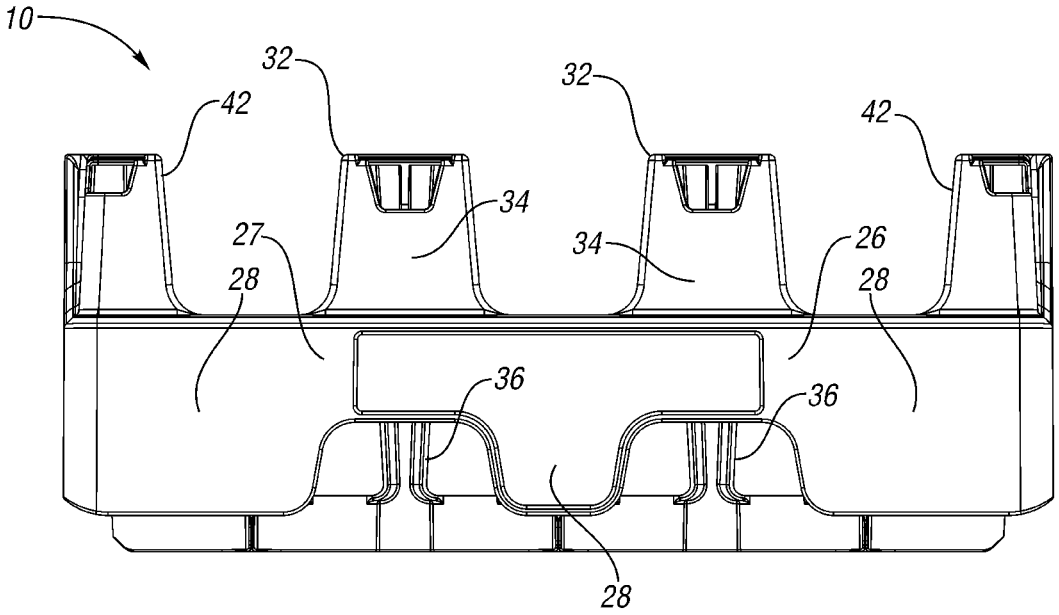
FIG. 6 is a side view of the tray.

FIG. 3 is a bottom view of the tray 10, showing the platforms 24, ribs 22 and openings 21. FIG. 4 is a top view of the tray 10, showing the pockets defined by the upper divider wall 20 of the lateral dividers 16 and longitudinal dividers 18. FIG. 5 is an end view of the tray 10. FIG. 6 is a side view of the tray 10.

Figure 7:
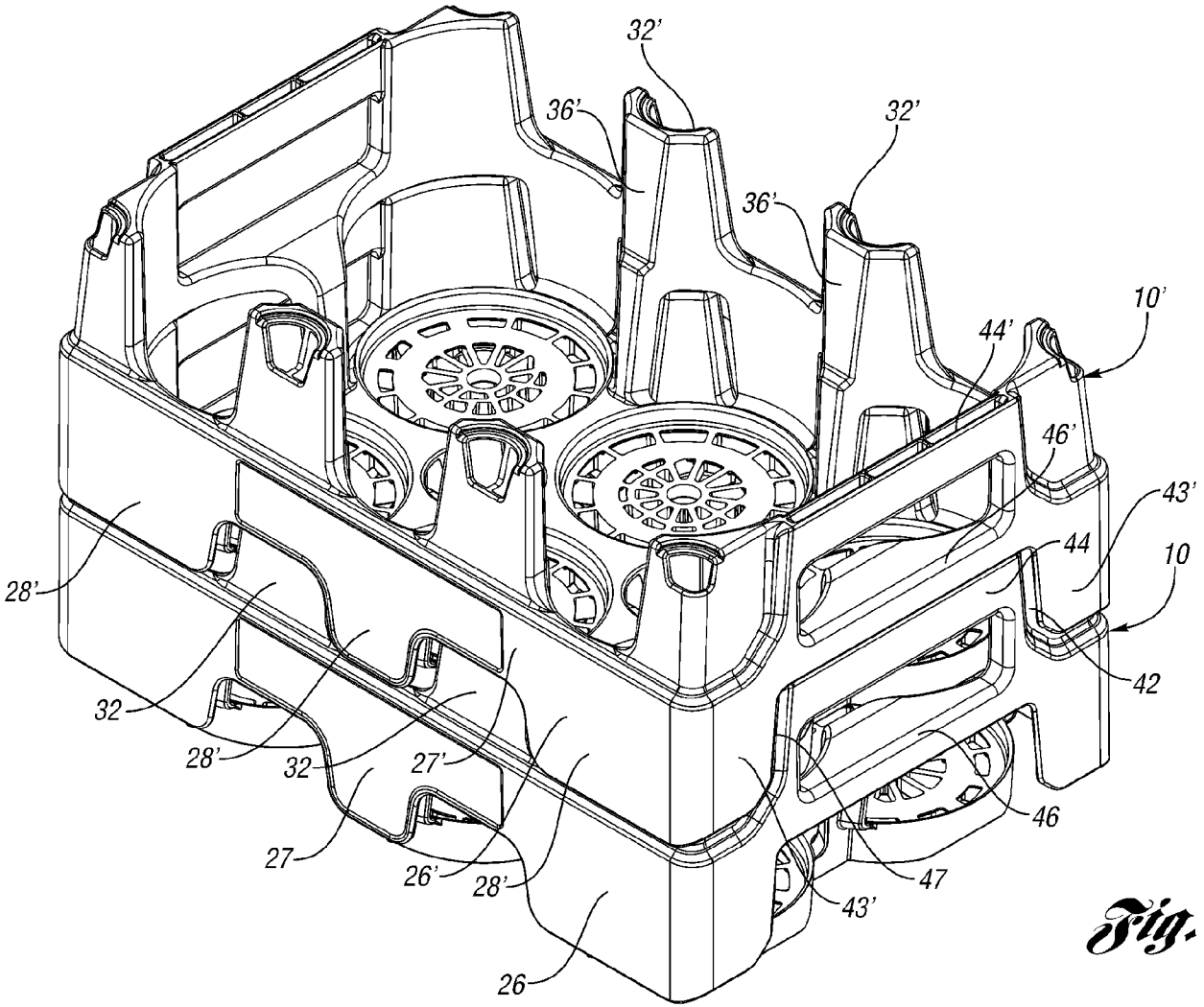
FIG. 7 is a perspective of the tray with a similar tray stacked thereon.

FIG. 7 shows the tray 10 of FIG. 1 with an identical tray 10' nested thereon. The upper bar 44 of the lower tray 10 is received within the opening 47' defined below the lower bar 46' in between the outer end walls 43'. The lower wall portions 28' of the side wall 26' of the upper tray 10' rest on the side wall 26 of the lower tray 10. The columns 32 of the lower tray 10 are received within the side wall 26' of the upper tray 10', between the upper wall portion 27' and the inner wall portions 36' of the columns 32' of the upper tray 10'.

Figure 8:
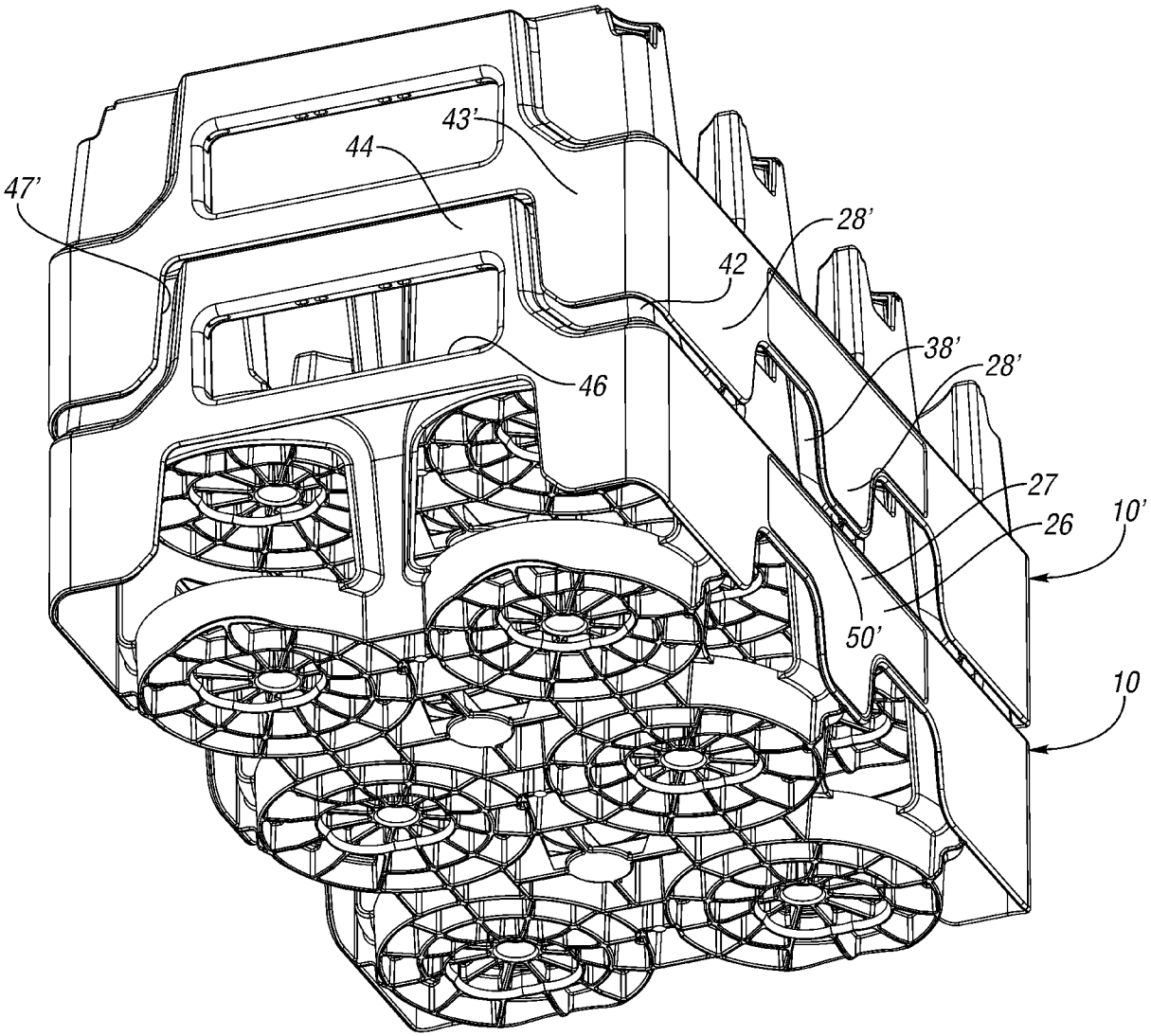
FIG. 8 is a bottom perspective view of the trays of FIG. 7.

Referring to FIG. 8, the corner columns 42 of the lower tray 10 are tapered to be received within the lower wall portions 28' and end outer walls 43' of the upper tray 10'. The perpendicular ribs 50' between the side lower wall portions 28' and side inner wall portions 38' of the upper tray 10' rest on the upper wall portion 27 of the side walls 26 of the lower tray 10.

Figure 9:
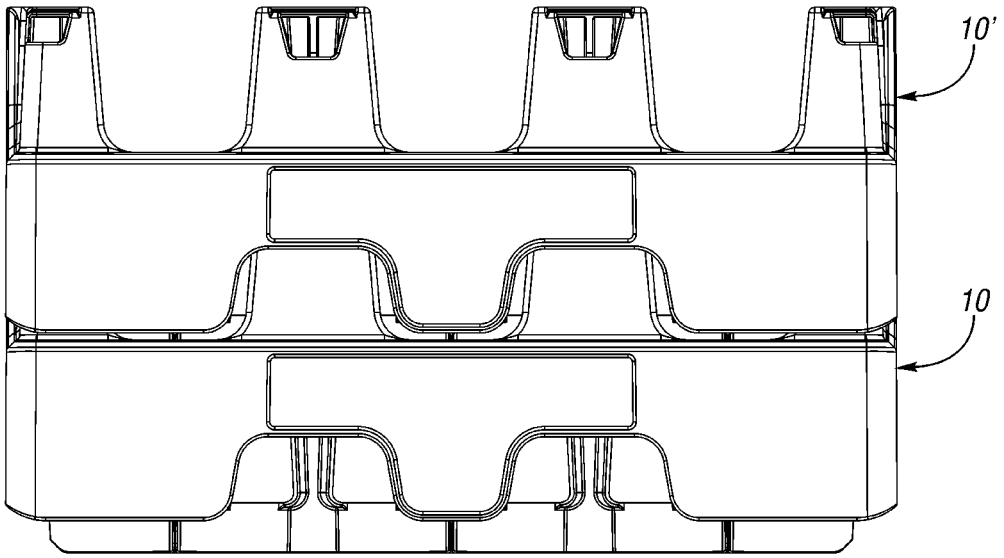
FIG. 9 is a side view of the trays of FIG. 7.
Figure 10:
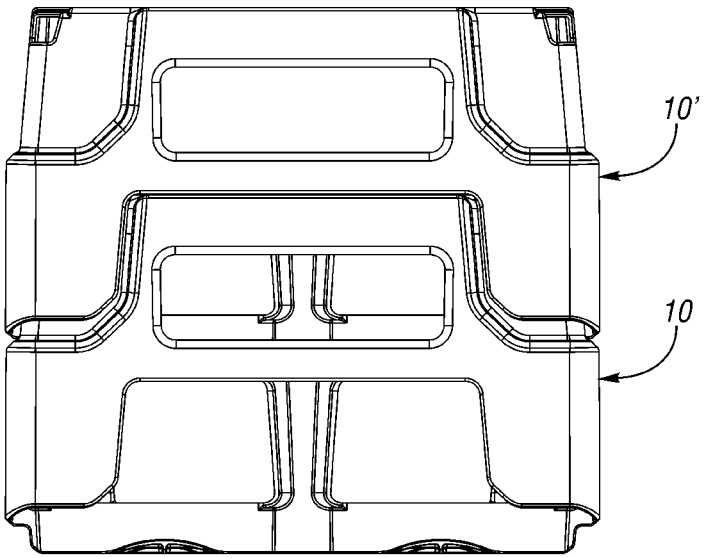
FIG. 10 is an end view of the trays of FIG. 7.
Figure 11:
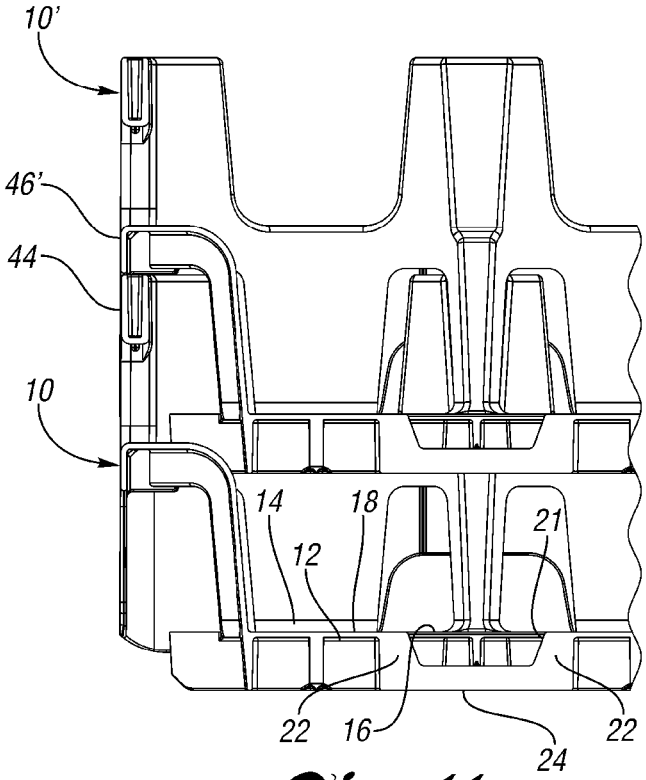
FIG. 11 is a section view through the center of one pair of the end walls of the trays of FIG. 7.

FIG. 9 is a side view of the trays of FIG. 7. FIG. 10 is an end view of the trays of FIG. 7. FIG. 11 is a section view of through a portion of the trays of FIG. 7. As shown, the upper bar 44 of the lower tray 10 is received below the lower bar 46' of the upper tray 10'. This section of FIG. 11 is also taken through the opening 21 through the intersection of the lateral divider 16 and longitudinal divider 18, and the associated ribs 22 and platform 24.

Figure 12:
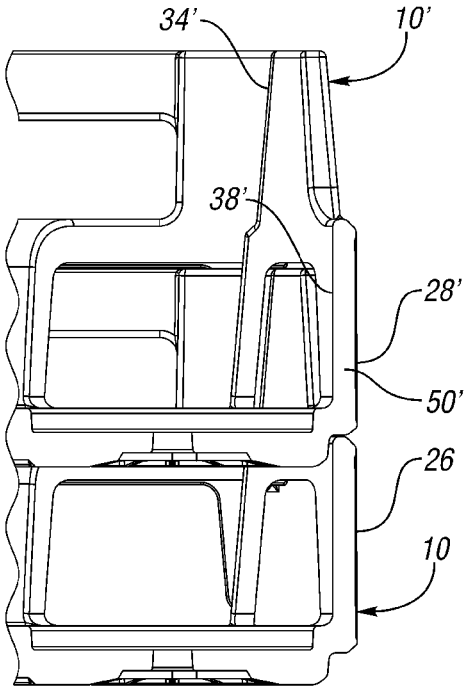
FIG. 12 is a section view through the center of one pair of the side walls of the trays of FIG. 7.

FIG. 12 is a section view through the perpendicular rib 50 connecting the lower wall portion 28 to the side inner wall portion 38. As shown, the rib 50 rests on the wall 26 of the lower tray 10.

Figure 13:
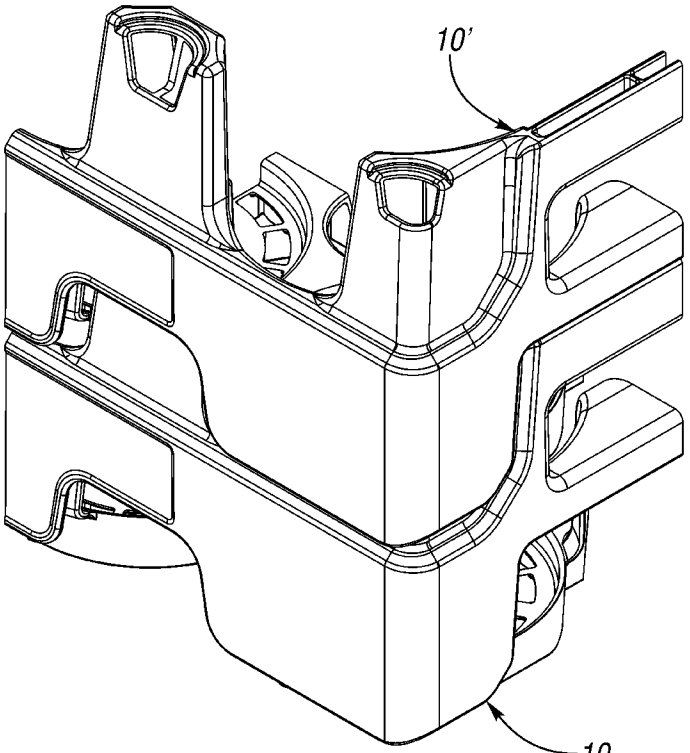
FIG. 13 is an exterior perspective view of the trays of FIG. 7, broken away along the section lines of FIGS. 11 and 12.

FIG. 13 is a perspective view of quarters of the trays 10, 10' of FIG. 7, which illustrates the section lines of FIGS. 11 and 12.

Figure 14:
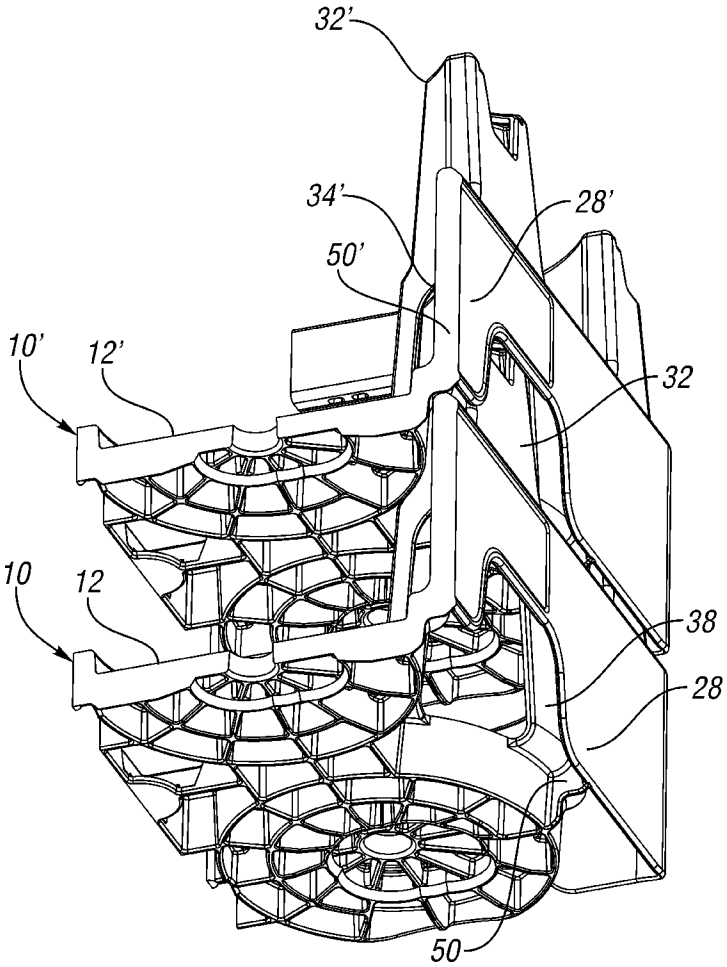
FIG. 14 is a bottom, side perspective view of the tray sections of FIG. 13.
Figure 15:
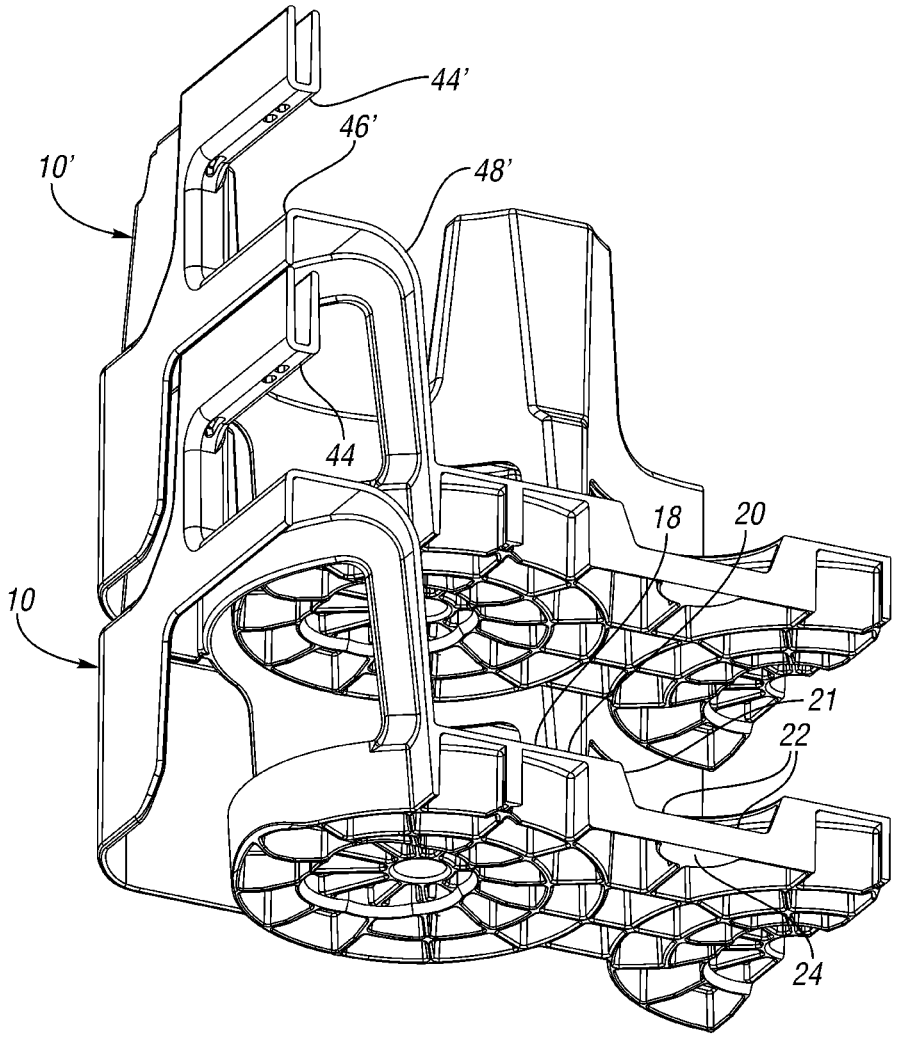
FIG. 15 is a bottom, end perspective view of the tray sections of FIG. 13.
Figure 17:
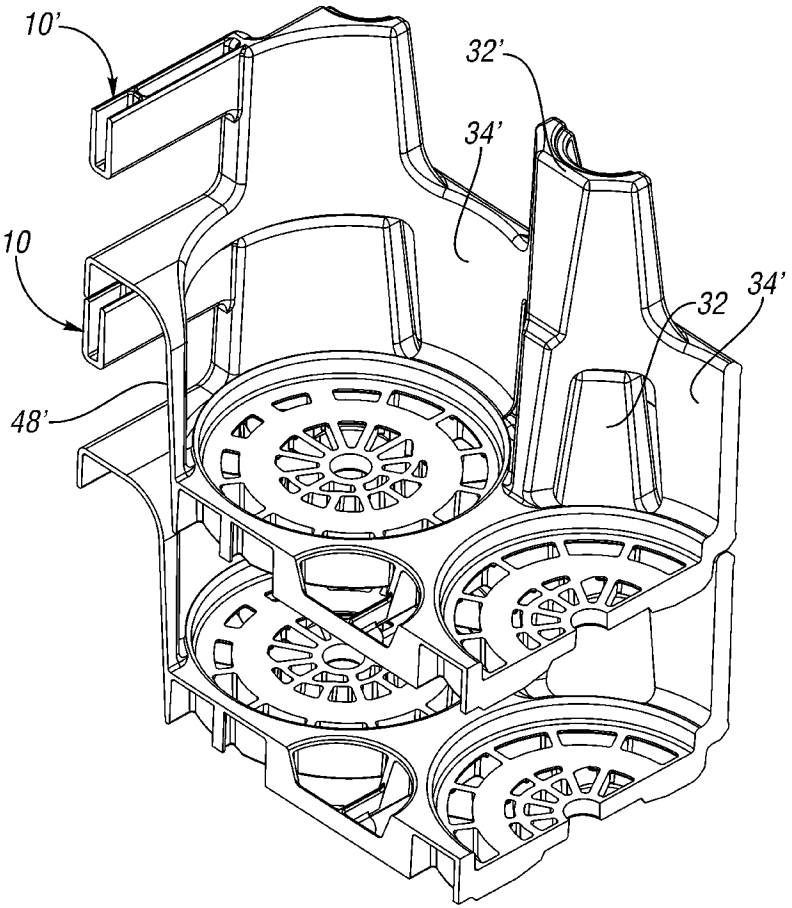
FIG. 17 is an interior, upper perspective view of the tray sections of FIG. 13.
Figure 16:
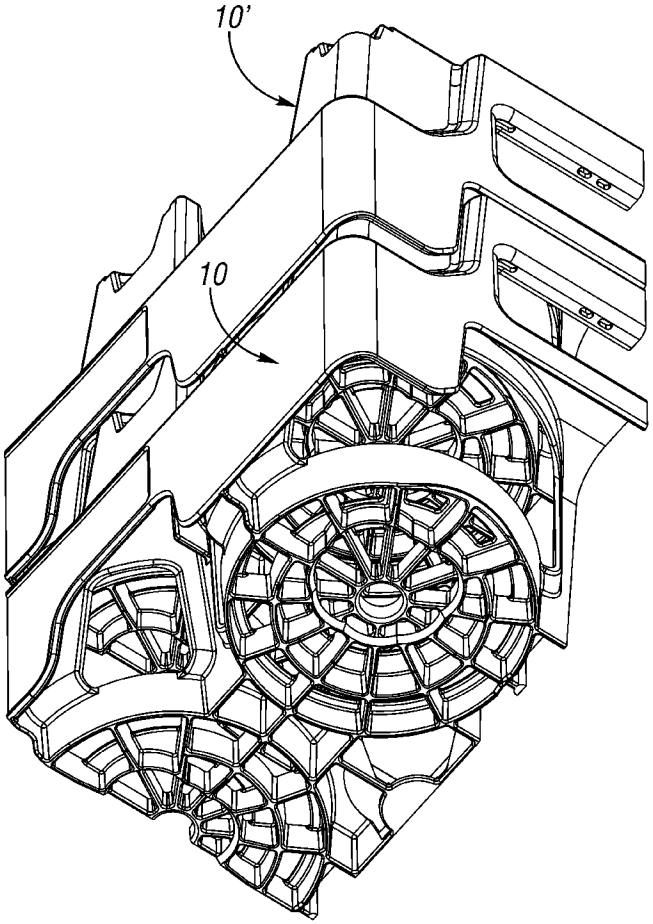
FIG. 16 is an exterior, bottom perspective view of the tray sections of FIG. 13.

FIG. 14 is a bottom perspective view of the quarter trays 10, 10' of FIG. 13. FIG. 15 is a lateral bottom perspective view of the quarter trays 10, 10' of FIG. 13. FIG. 16 is a bottom perspective view of the quarter trays 10, 10' of FIG. 13. FIG. 17 is an interior upper perspective view of the quarter trays 10, 10' of FIG. 13.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:

a base including a plurality of base walls each having a peripheral wall defining a container-receiving pocket therein, adjacent pairs of the peripheral walls of the base walls being spaced apart to define low-profile lateral and longitudinal dividers, each peripheral wall extending upward generally perpendicularly from the one of the plurality of base walls, the base including an upper divider wall connecting upper ends of the peripheral walls between the peripheral walls;

a pair of opposed side walls, the side walls each including an upper portion and a plurality of spaced apart lower portions;

a plurality of side columns having outer walls extending up from the upper portions of the side walls and having inner walls extending down to the base, the side columns arranged between the spaced apart lower portions of the side walls; and a pair of opposed end walls, each end wall including an upper bar and a lower bar extending between a pair of corner columns, a handle opening defined between the upper bar and the lower bar, each lower bar connected to the base by an end inner wall, a recess is defined below the lower bar outwardly of the end inner wall for receiving the upper bar of a lower identical tray nested therebelow, wherein there are only six base walls arranged in a two by three configuration between the pair of opposed end walls and between the pair of opposed side walls.

2. The tray of claim 1 wherein the base walls are connected to one another by a plurality of vertical base-connecting ribs that are substantially co-planar with the base walls, the base-connecting ribs extending downward from the upper divider wall.

3. The tray of claim 1 wherein the upper divider wall includes an opening at an intersection of the lateral and longitudinal dividers, wherein ribs extend downward from the upper divider wall across the opening through the upper divider wall.

4. The tray of claim 1 wherein the lower bars are coplanar with the upper portions of the side walls to provide a continuous perimeter band around the tray.

5. The tray of claim 1 wherein there are no dividing walls above the upper divider wall.

6. The tray of claim 1 wherein two of the plurality of base walls are centered between the end walls.

7. The tray of claim 6 wherein centers of each of the container-receiving pockets are equidistant along longitudinal and lateral directions.

8. The tray of claim 1 wherein the upper divider walls of the lateral and longitudinal dividers have a portion of narrowest width that is greater than a height of the peripheral walls of the lateral and longitudinal dividers.

9. A tray for storing and transporting bottles comprising:

a base including a plurality of base walls each having a peripheral wall extending upward generally perpendicularly therefrom, each peripheral wall defining a container-receiving pocket therein, adjacent pairs of the peripheral walls of the base walls being spaced apart to define low-profile lateral and longitudinal dividers, the base including an upper divider wall connecting upper ends of the peripheral walls between the peripheral walls, wherein each upper divider wall is generally parallel to the base, the lateral and longitudinal dividers having a narrowest width that is greater than their height;

a pair of opposed side walls, the side walls each including an upper portion and a plurality of spaced apart lower portions;

a plurality of side columns having outer walls extending up from the upper portions of the side walls and having inner walls extending down to the upper divider wall, the side columns arranged between the spaced apart lower portions of the side walls, wherein there are only six base walls arranged in a two by three configuration between the pair of opposed end walls and between the pair of opposed side walls; and a pair of opposed end walls, each end wall including an upper bar and a lower bar extending between a pair of corner columns, a handle opening defined between the upper bar and the lower bar, each lower bar connected to the base by an end inner wall, a recess is defined below the lower bar outwardly of the end inner wall for receiving the upper bar of a lower identical tray nested therebelow.

10. The tray of claim 9 wherein the base walls are connected to one another by a plurality of vertical base-connecting ribs that are substantially co-planar with the base walls, the base-connecting ribs extending downward from the upper divider wall.

11. The tray of claim 9 wherein the upper divider wall includes an opening at an intersection of the lateral and longitudinal dividers, wherein ribs extend downward from the upper divider wall across the opening through the upper divider wall.

12. The tray of claim 9 wherein the lower bars are coplanar with the upper portions of the side walls to provide a continuous perimeter band around the tray.

13. The tray of claim 9 wherein there are no dividing walls above the upper divider wall.

14. The tray of claim 9 wherein two of the plurality of base walls are centered between the end walls.

15. The tray of claim 1 wherein each peripheral wall extends upward from one of the plurality of base walls.

16. The tray of claim 1 wherein each upper divider wall is generally parallel to the base and generally perpendicular to the peripheral walls.

17. The tray of claim 9 wherein there are only six base walls arranged in a two by three configuration between the pair of opposed end walls and between the pair of opposed side walls.

18. A tray for storing and transporting bottles comprising:

a base including a plurality of base walls each having a peripheral wall defining a container-receiving pocket therein, wherein each peripheral wall extends upward generally perpendicularly from the one of the plurality of base walls, adjacent pairs of the peripheral walls of the base walls being spaced apart to define low-profile lateral and longitudinal dividers, the base including a generally horizontal upper divider wall connecting upper ends of the peripheral walls between the peripheral walls;

a pair of opposed side walls, the side walls each including an upper portion and a plurality of spaced apart lower portions;

a plurality of side columns having outer walls extending up from the upper portions of the side walls and having inner walls extending down to the base, the side columns arranged between the spaced apart lower portions of the side walls; and a pair of opposed end walls, each end wall including an upper bar and a lower bar extending between a pair of corner columns, a handle opening defined between the upper bar and the lower bar, each lower bar connected to the base by an end inner wall, a recess is defined below the lower bar outwardly of the end inner wall for receiving the upper bar of a lower identical tray nested therebelow.

* * * * *